US006389773B1

(12) United States Patent
Reuter et al.

(10) Patent No.: US 6,389,773 B1
(45) Date of Patent: May 21, 2002

(54) STACKABLE PANEL SYSTEM FOR MODULAR OFFICE FURNITURE

(75) Inventors: Robert E. Reuter, East Setauket, NY (US); Wallace C. Bullwinkle, Gilbertsville; Ronald A. Snyder, Allentown, both of PA (US)

(73) Assignee: Knoll, Inc., East Greenville, PA (US)

( * ) Notice: Subject to any disclaimer, the term of this patent is extended or adjusted under 35 U.S.C. 154(b) by 0 days.

(21) Appl. No.: 09/520,253

(22) Filed: Mar. 7, 2000

Related U.S. Application Data

(60) Provisional application No. 60/137,582, filed on Jun. 4, 1999.

(51) Int. Cl.[7] ..... E04B 2/08

(52) U.S. Cl. ..... 52/582.2; 52/239; 52/242; 52/282.1; 52/582.1; 52/584.1; 52/585.1; 52/586.1; 403/353; 403/389; 160/135; 160/231

(58) Field of Search ..... 52/222, 238.1, 52/239, 242, 564.1, 562.1, 562.2, 566.1, 565.1, 261, 202.1, 461.1, 461.2; 403/353, 369; 160/135, 231

(56) References Cited

U.S. PATENT DOCUMENTS

| | | | |
|---|---|---|---|
| 2,114,387 | A | 4/1938 | Killion |
| 2,114,388 | A | 4/1938 | Killion |
| 3,839,834 | A | 10/1974 | Goddard |
| 4,094,113 | A | 6/1978 | Good |
| 4,144,924 | A | 3/1979 | Vanden Hoek |
| 4,448,003 | A | 5/1984 | Hasbrouck |
| 4,535,577 | A | 8/1985 | Tenser et al. |
| 4,567,698 | A | 2/1986 | Morrison |
| 4,581,869 | A | 4/1986 | Reuter |
| 4,619,486 | A | 10/1986 | Hannah et al. |
| 4,631,881 | A | 12/1986 | Charman |
| 4,667,450 | A | 5/1987 | Stefnik et al. |
| 4,876,835 | A | 10/1989 | Kelley et al. |
| 4,881,349 | A | 11/1989 | Brown et al. |

(List continued on next page.)

OTHER PUBLICATIONS

Knoll, Inc., *REFF Planning Guide*, 1998, pp. 10, 44–50 and 64.

*Primary Examiner*—Carl D. Friedman
*Assistant Examiner*—Yvonne M. Horton
(74) *Attorney, Agent, or Firm*—Buchanan Ingersoll, P.C.

(57) ABSTRACT

A stackable panel system having a versatile corner supporting arrangement for addition onto existing wall systems for a modular office system. The corners of the stackable panel include a sliding engagement scheme, wherein a mast assembly is secured to a top portion of the wall system by a mast base and slidably engages a central open area of a corner support on the stackable panel by means of a vertically oriented mast upright. Additional panels can be added to the stackable panels by means of intermediate connectors. On the upper portion of the top panel, a corner trim piece covers over the central open area of the top corners. A top connector helps to rigidly secure adjacent stackable panels, either with a T-shaped, L-shaped or X-shaped connection. A perimeter framing system utilizing the corner support arrangement for the stackable panels is also provided. Each of the frame members includes a semi-circular section and a flat section. The frame members are secured to the corner connectors having a matching cross section by means of screws which are threadingly engaged with the flat portions and pass into the semi-circular areas such that the open area of the frame does not have the frame securing elements projecting therein. In a further embodiment, a floor mounted mast assembly is provided for using the stackable panels of the present invention as a room space divider. In addition, the corner supports can be attached to existing panels so that they may be used with prior art systems to convert them into stackable panels of the present invention having a sliding engagement mechanism.

38 Claims, 12 Drawing Sheets

U.S. PATENT DOCUMENTS 4,883,330 A 11/1989 Armstrong et al.
4,942,713 A * 7/1990 Jackson ..... 52/584
5,024,030 A 6/1991 Morrison
D321,801 S 11/1991 Friedman
5,134,826 A * 8/1992 La Roche et al. ..... 52/584
5,179,810 A * 1/1993 Gename et al. ..... 52/240
5,212,918 A * 5/1993 Newhouse et al. ..... 52/126.3
5,579,621 A * 12/1996 Fang ..... 52/483.1
6,141,926 A * 11/2000 Rossiter et al. ..... 52/239

* cited by examiner

STACKABLE PANEL SYSTEM FOR MODULAR OFFICE FURNITURE

CROSS REFERENCE TO RELATED APPLICATIONS

This patent application is closely related to our pending provisional patent application titled, "STACKABLE PANEL SYSTEM FOR MODULAR OFFICE FURNITURE" filed on Jun. 4, 1999 and assigned Ser. No. 60/137,582.

BACKGROUND OF THE INVENTION

1. Field of the Invention

The present invention relates to modular office wall and panel systems, and more particularly to a stackable panel assembly having a universal engagement mechanism incorporated into its frame for use with new or existing office wall systems.

2. Description of the Prior Art

In modem interior office design, it is important to have versatility in construction and reconfiguration of office paneling systems. In particular, wall systems of various heights have been used to enhance the aesthetics of the work environment. For example, wall panels can come in various heights and widths such as 39 inches, 48 inches and 64 inches high or 24 inches, 36 inches, 48 inches and 60 inches wide. In addition, numerous types of panels can be used in these modular wall systems, such as clear glass, fiber coated panels, composite material covered panels, translucent materials or metal, perforated mesh panels. Each of these panels should be capable of being interchangeably used within a wall system in order to create a variety of appearances.

In addition, freestanding wall panels, such as may be used for room dividers,for example, are also utilized within the open office environment. These panels can be used to divide the work area but may not be structurally designed for supporting office accessories such as book shelves and the like, which are commonly found on office wall panel systems. At times, after the office modular system has been installed, it may later be desired to change the look of the office for a variety of reasons, either by increasing panel height, changing panel coverings or further dividing the work area In the past, this generally involves the removal or deconstruction of the office layout and the installation of new office wall systems and panels. It would be advantageous, therefore, to have a means whereby existing office panel systems can be reconfigured by the addition of new panels without the need to significantly disassemble current panels or wall system layouts. Additionally, it is desired to be able to reconfigure any type of office system from a variety of manufacturers.

It is therefore an object of the present invention to provide a panel system which can be added on or stacked upon an existing wall system.

It is a further object of the present invention to have a panel system which can also be used in a free standing mode, such as a room area divider.

It is a still further object of the present invention to provide a panel system which can be standardized and attached to any type of wall configuration to be able to configure the wall system with any type of panel.

It is yet another object of the present invention to provide a panel which can utilize any type of covering or fabric so as to provide a variety of options for the appearance of the modular office system.

It is another object of the present invention to provide a means for converting existing panels or systems into a stackable panel system.

It is yet a still further object of the present invention to provide a panel framing system which incorporates a stackable panel design.

SUMMARY OF THE INVENTION

In accordance with one embodiment of the present invention, a panel system comprises a perimeter frame, wherein each corner of the perimeter frame includes a corner support member. Each of the corner supports comprises a generally L-shaped member having a central open area, one leg of the L-shaped corner support having a first portion of a sliding engagement mechanism thereon. Means for supporting the perimeter frame in an upright position, either upon a second panel, the top portion of a wall or upon the floor, are provided, the supporting means having a second portion of the sliding engagement mechanism and adapted to receive the first portion on the L-shaped corner support therein. In one embodiment, the first portion comprises a pair of opposed rails which project into the central open area and the second portion comprises a pair of complementary shaped grooves for slidably receiving the opposed rails.

In another embodiment of the stackable panel system for adding onto a top portion of a modular office wall system, the stackable panel system comprises a perimeter frame and a corner support member disposed on each of the corners of the perimeter frame. Each of the corner support members includes a centrally open area and a first leg portion including a pair of opposed rails disposed within the centrally open area. A mast assembly comprising a mast base is secured to a top portion of the modular office wall system and a mast upright is attached to the mast base, wherein the mast upright includes a pair of opposed grooves adapted to receive the opposed rails of the corner support member. A corner filler trim piece generally corresponding to the corner support member is provided as a finished trim piece, one leg of the trim member having a second pair of opposed grooves for receiving the opposed rails of the corner support member, and a plurality of perimeter trim means is disposed about the perimeter frame between the corner support members. In this manner, an outer surface of each of the corner support members, the mast upright, the corner trim members and said perimeter trim means are generally compatible to provide an aesthetically pleasing appearance. Preferably, these components have a substantially identical outer surface for a uniform wall panel perimeter.

In order to construct the stackable panel of the present invention, for example, a perimeter frame for an office panel is provided. The perimeter frame comprises a plurality of frame members, each of the frame members comprising, in cross section, a generally semi-circular interior frame section and an opposed generally flat exterior frame section. A plurality of corner connectors are used to securely join the plurality of frame members, each of said corner connectors being of a generally L-shaped configuration having a circular member receivable within the generally circular interior frame section and a generally flat portion in abutting relationship with the opposed generally flat exterior frame section. Means are provided for securing the plurality of corner connectors to the plurality of frame members such that the securing means are not visible within an interior area defined by the perimeter frame. By way of example, screws may be threadingly secured to the corner connectors and the flat exterior frame section, whereby they project into the generally semi-circular interior frame section and are thereby "hidden".

In order to convert an existing modular office panel into a stackable panel of the present invention, a corner mounting arrangement kit may be provided. The kit comprises a plurality of generally L-shaped corner supports, each of which includes a generally open central area and one leg of the L-shaped corner support has a first portion of a sliding engagement mechanism, such as opposed rails projecting into the open area. A plurality of mast assemblies are provided, each having a second portion of the sliding engagement mechanism, such as a pair of opposed grooves complementary to the shape of the rails. The mast assemblies can support the panel either on top of an existing wall system or upon the floor. The kit further comprises a plurality of corner trim pieces also including the second portion of the sliding engagement mechanism, and a plurality of top connectors for joining adjacent panels. The outer surface of each of the components of the kit are generally compatible so as to provide for an aesthetically pleasing appearance for the converted stackable panel. In addition, the kit may include a plurality of intermediate connectors for adding up additional stackable panels.

BRIEF DESCRIPTION OF THE DRAWINGS

Various other objects, features and advantages of the invention will become more apparent by reading the following description in conjunction with the drawings, which are shown by way of example only, where.

DETAILED DESCRIPTION OF THE PREFERRED EMBODIMENTS

Figure 1:
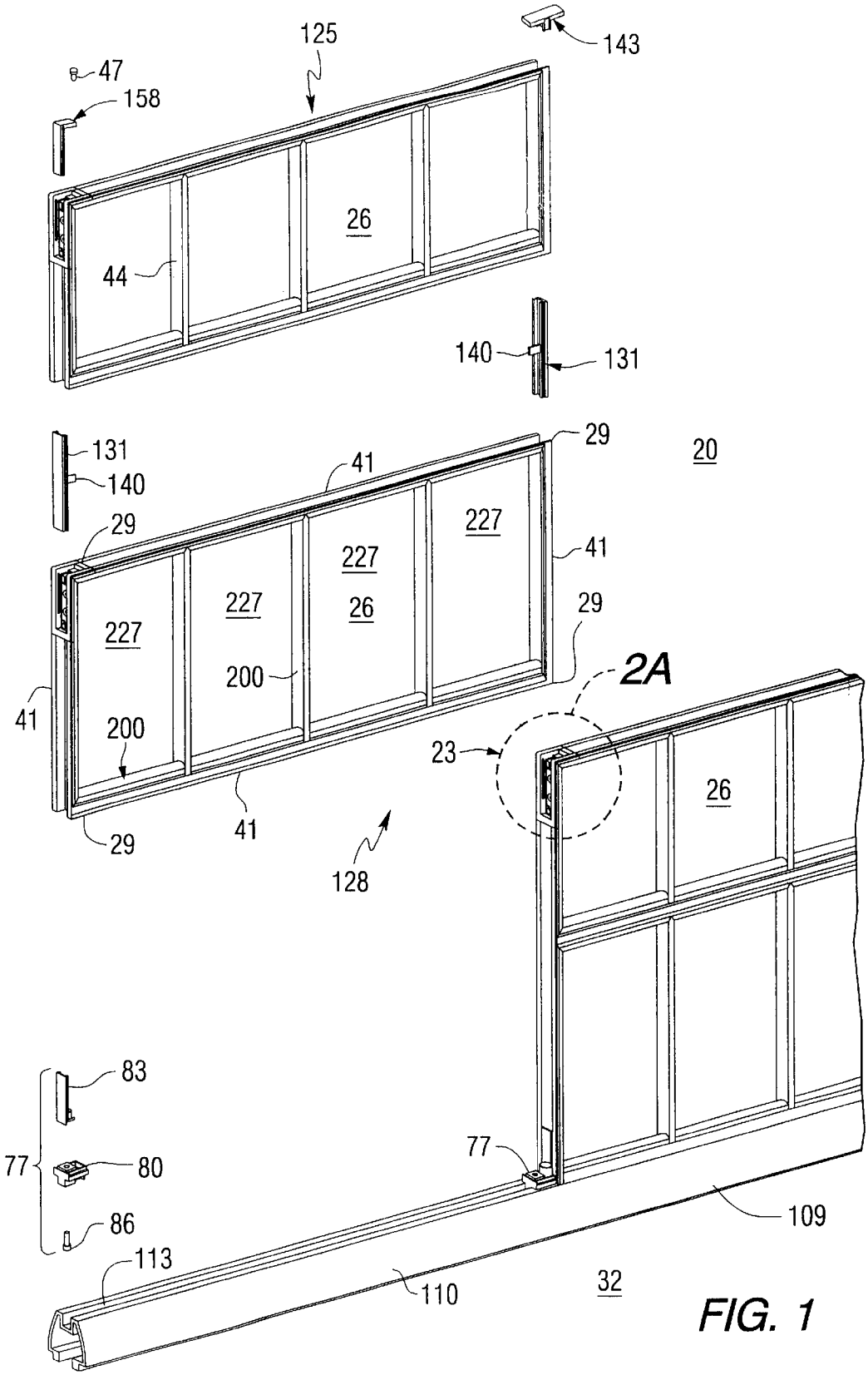
FIG. 1 is a perspective view of one embodiment of the stackable panel system of the present invention installed as part of a modular office wall system.
Figure 2A:
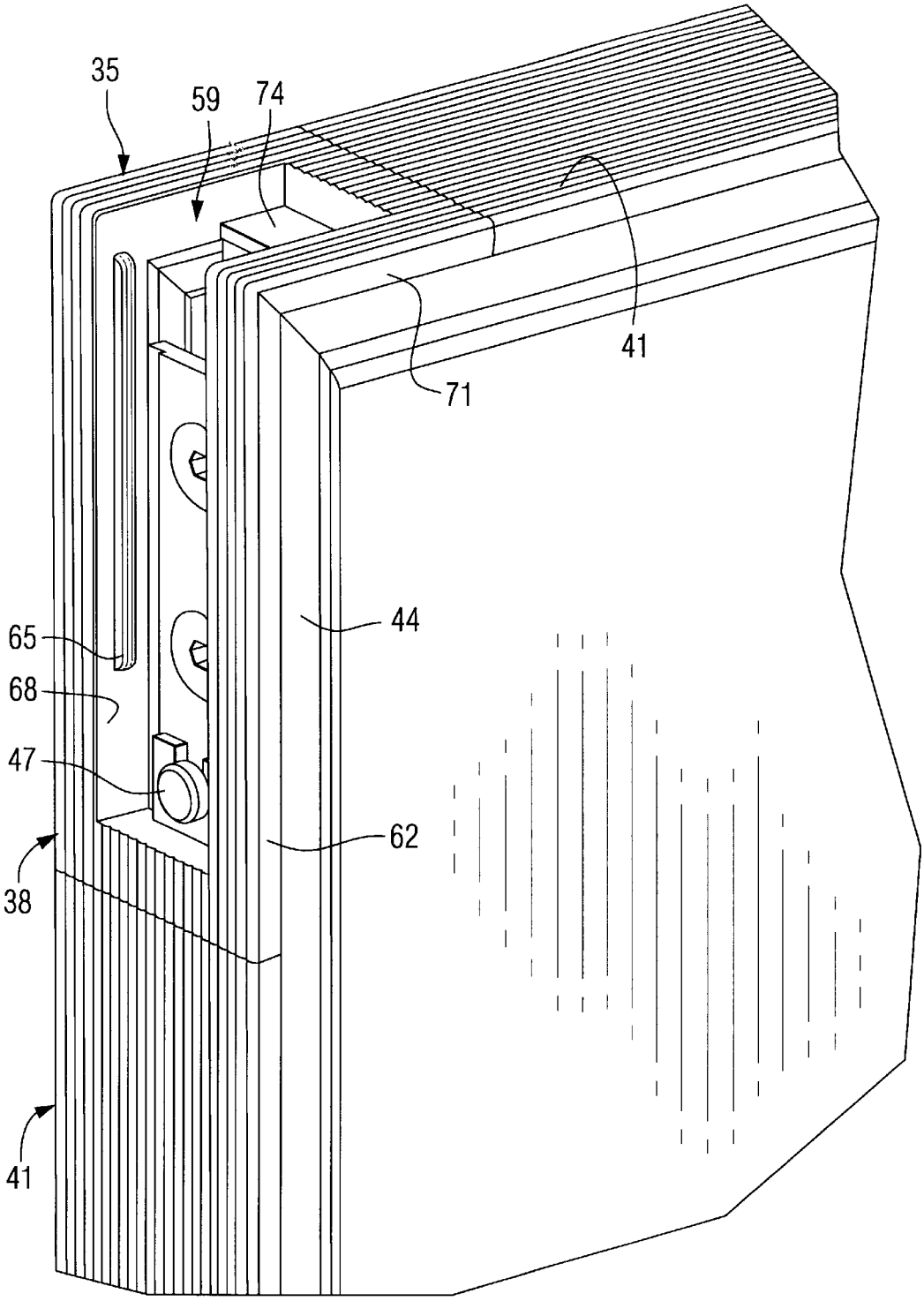
FIG. 2, consisting of FIGS. 2A and 2B, illustrates a perspective view of a corner support, FIG. 2A showing the corner support attached to a stackable panel system and FIG. 2B showing only the corner support.
Figure 2B:
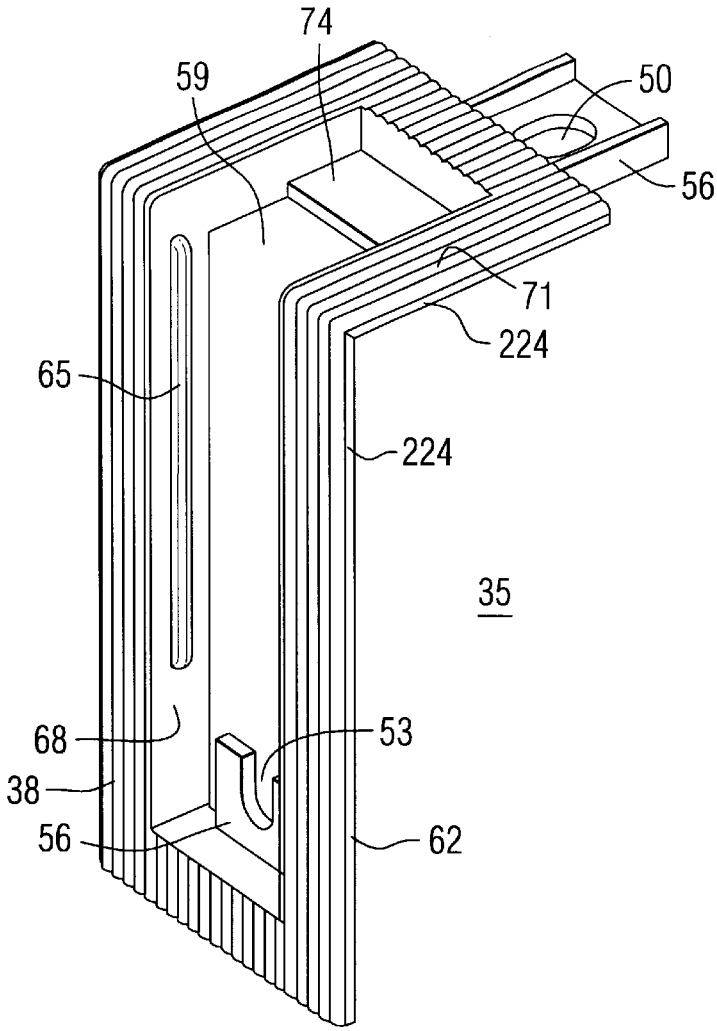

Referring now to the drawings in detail, there is shown in FIG. 1 a stackable panel system 20 which incorporates a unique corner mounting arrangement 23 which allows a panel to be adapted or added on to any type of wall system. In a preferred embodiment, the stackable panels 26 include the corner support arrangement 23 at each of the four corners 29, which allow such stackable panels to be added to any type of wall system or open office modular panel system 32. The corner support arrangement 23, shown in detail in FIG. 2, preferably comprises a pretrimmed generally L-shaped component 35 which has an outer surface 38 which matches the outer surface of an extruded panel trim 41 which is placed around the perimeter of a typical panel 26 in the areas defined between the corner supports 35. The L-shaped corner supports 35 are attached to the frame 44 of the office panel preferably by means of two screws 47 which pass through appropriate openings 50 or slots 53 within attachment tabs 56 on the legs of the corner support 35 so as to secure the corner supports 35 to the panel frame 44. The corner supports 35 have an open central area 59, the long portion or leg 62 of the L-shaped corner support 35 including a pair of rails 65 which project inwardly from the sides 68 of the long portion 62. The rails 65 form a first portion of a sliding engagement mechanism. On the shorter portion or leg 71 is included a rectangular recessed area 74 for receiving various elements of the corner mounting arrangement as will be more fully described hereinafter.

Figure 4:
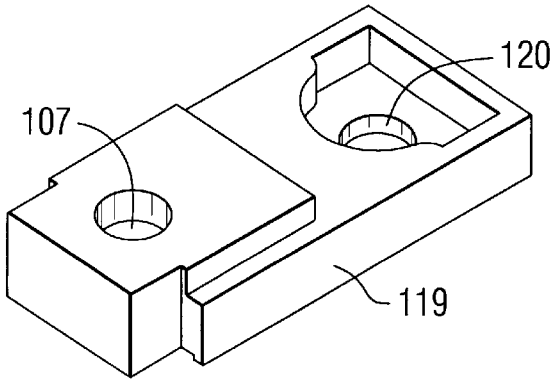
FIG. 4 is a perspective view of another embodiment of a mast base for the mast assembly of the present invention.
Figure 3:
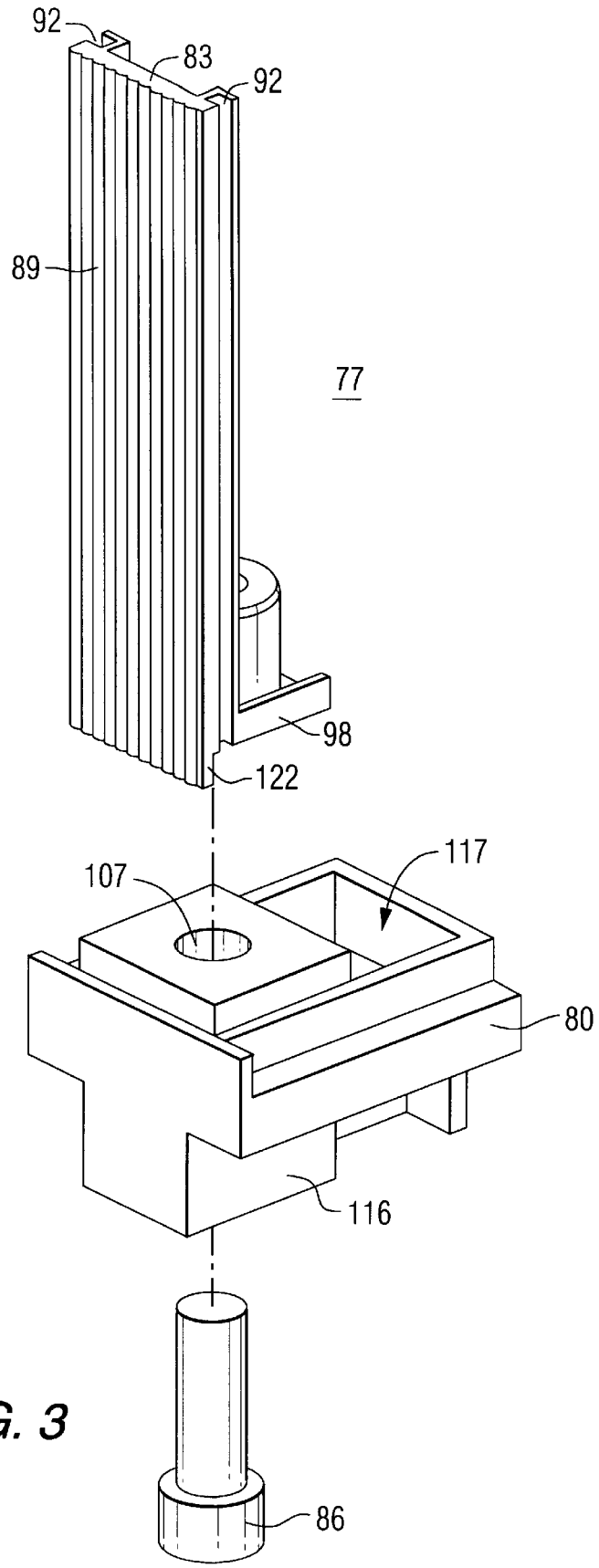
FIG. 3 is an exploded view of one embodiment of a mast assembly for the present invention.
Figure 5:
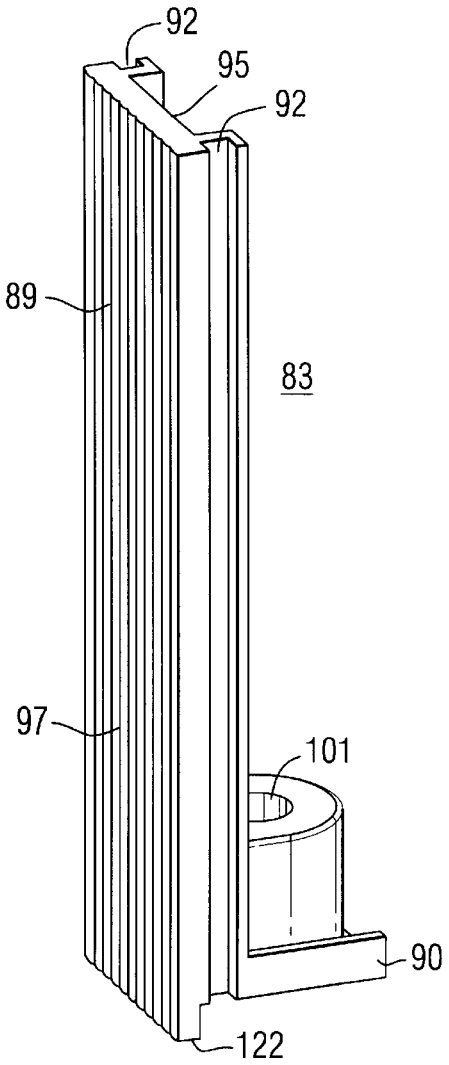
FIG. 5 is a detailed perspective view of a mast upright of the present invention.

In order to attach a stackable panel 26 to the top of an existing wall segment 32, a mast assembly 77 is utilized. As shown in FIGS. 3–5, the mast assembly comprises a mast base 80 which is secured to a mast upright 83, such as by a bolt 86. The mast upright 83 also has an outer surface 89 which preferably matches the panel trim 41 on the panel frame 44 and the outer surface 38 of the corner support 35. The mast upright 83 (FIG. 5) includes, on either side thereof, a groove 92 which forms a second portion of the sliding engagement mechanism and generally matches the dimensions of the rails 65 found on the inside surface 68 of the corner supports 35. The grooves 92 of the mast upright 83 engage these rails 65 such that the stackable panel 26 is secured to the mast upright 83 and thus the existing wall system 32. Additionally, on the inside surface 95 of the mast upright, opposite the trimmed outer surface 89 which is visible to a person, is a generally rectangular cutout portion (not shown) into which the screw 47 which attaches the corner support 35 to the frame 44 can be received with adequate clearance so that the assembled mast and corner assembly provides an aesthetically pleasing appearance for the stacked panel. Additionally, although the rails 65 and grooves 92 are shown to be generally rectangular, it will be understood by those skilled in the art that this slidable engagement mechanism can be of any complementary cross section, such as a dove tail connection. Moreover, it will also be understood by those skilled in the art that the mast upright may incorporate the rails, and the corner supports the complementary shaped grooves, to form the slidable engagement mechanism for the corner mounting arrangement.

According to presently preferred embodiment, the mast upright 83 is comprised of two separate components: the vertical member 97 which engages in the rails 65 of the corner support 35, and a securement block 98 which has a threaded opening 101 to recieve the bolt 86. Although the securement block 98 may be a seperate piece to vertical member 97, such as by welding, the vertical member and securement block can also be formed as an integral one piece component for the mast upright 83. As was stated previously, the mast upright 83 is secured to the mast base 80 such as by a bolt 86 which passes through a hole 107 in the mast base from the bottom and projects upward to be threadingly engaged with the threaded opening 101 in the mast securement block 98. The mast base can be of several forms, such as shown in FIGS. 3 and 4, according to the type of panel or wall assembly to which the stackable panels of the present invention are to be attached. For example, an embodiment of a wall system, such as is disclosed in copending application Ser. No. 08/864,138 which is now U.S. Pat. No. 6,167,664, issued Jan. 2, 2001 entitled Hybrid Office Panel Construction flora Modular Office Furniture System which is assigned to the present assignee and is incorporated herein by reference includes a top portion 109 having a crown member 110 which has a grooved portion 113 into which the mast base 80 shown in FIG. 3 may be received. This mast base includes a corresponding rectangular lower segment 116 which can be inserted into the groove 113 and the mast base secured to the crown 110, such as by two bolts (not shown) which pass through openings 117 in the mast base 80. The mast base 80 is secured to the crown 10 after the mast upright 83 has been bolted 86 thereto (see FIG. 1). For a wall system having a relatively flat top portion 109, the mast base 119 shown in FIG. 4 is preferably used. It is secured to the wall in a similar manner as discussed above, such as by a bolt (not shown) passing through opening 120 and threadingly engaging the top portion of the wall assembly.

Additionally, the mast upright and mast base can also be formed as an integral component such that only the mast base need be secured to the crown, for example, rather than having to secure two pieces initially. One embodiment of an integral base is described more fully hereinafter with respect to a freestanding stackable panel system. However, due to the fact that differing types and shapes of mast bases are utilized in order to incorporate the present invention with any type of wall system, it is presently preferred to have a two piece mast assembly such that only one mast upright need be manufactured and only the mast base need be customized for each application, depending on the type or manufacturer of the wall system to which the stackable panel system of the present invention is to be added. Preferably the mast upright 83 includes a leg portion 122 which overhangs a portion of the mast base 80. Additionally, the securement block 98 passes through the central open area 59 on the shorter portion 71 of the corner support 35 and the mast base 80 rests within the recessed rectangular area 74.

As shown in FIG. 1, two mast assemblies 77 are secured to the top portion 109 of a wall assembly 32 according to the width of the stackable panel 26 of the present invention. Since the mast base 80 can be secured anywhere along the crown 110, for example, panels of any size may be manufactured and used for any of the variety of wall systems. After the mast assemblies have been secured in place, the panels can be attached to the mast uprights 83 as hereinafter described.

Figure 6:
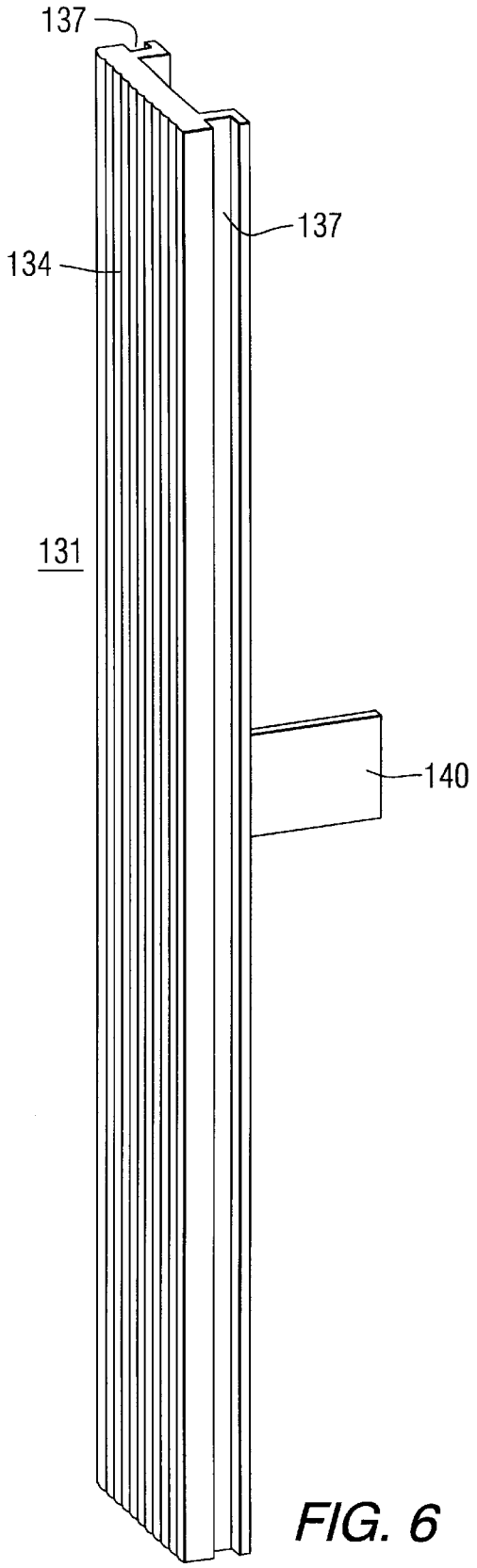
FIG. 6 is a perspective view of an intermediate connector for the stackable panels system of the present invention.

The rails 65 on the longer portion 62 of the L-shaped corner support 35 slidingly engage the corresponding grooves 92 in the mast upright 83 and thereby secure the panel 26 to the crown 110 on the top portion 109 of an existing wall 32. Since each of the four corners 29 of the stackable panel include the corner support 35 of the present invention, additional or upper 125 stackable panels can be stacked upon the first or lower panel 128 which is attached to the top portion 109 of the wall. This is accomplished by way of an intermediate connector member 131 shown in FIG. 6, which generally is twice the length of mast upright 83 and generally spans the distance between two corresponding corner supports 35 of an upper 125 and lower 128 stackable panel. The intermediate connector 131 also has a pre-trimmed outer surface 134 and the second portion of the sliding engagement mechanism or grooves 137 on either side. The intermediate connector 131 is installed into the upper left corner, for example, of the lower stackable panel 128 as shown in FIG. 1 and engages the rails therein. The intermediate connector, on the side opposite the pre-trimmed outer surface 134, also includes two rectangular cutout portions on each end for clearance between the screw heads used to attach the corner supports to the panel frames 125, 128 and the intermediate connector 131. Approximately one half of the intermediate connector extends above a top surface of the lower panel 128. Thus, the intermediate connector projects above the top surface of the lower panel 128 in much the same manner as the upright mast extends upward from the top portion 109 of the wall. One intermediate connector 131 is attached to either side of the lower panel 128. A second or upper stackable panel 125 is then installed over the lower panel by inserting the top half of the intermediate connector 131 into the corresponding central open areas 59 of the corner supports 35 on the lower portion of the upper stackable panel 125 and inserting the rails 65 thereof into the corresponding grooves 137 of the intermediate connector 131. Although the dimensions of the intermediate connector are generally equal to twice the length of the longer leg portion 62 of an individual corner support 35, there may be a gap which exists between either end of the intermediate connector 131 and the corner supports. For this reason, a spacer member 140 may be incorporated into the midpoint section of the intermediate connector 131 so as to provide an equal, smaller gap between the ends of intermediate connectors and the corner supports on the outside of the upper and lower stacked panels, such that a uniform appearance is provided for the wall system. As was stated previously, the intermediate connector 131 may include the rails for the sliding engagement mechanism if the corner support 35 has the complementary grooves.

Figure 7:
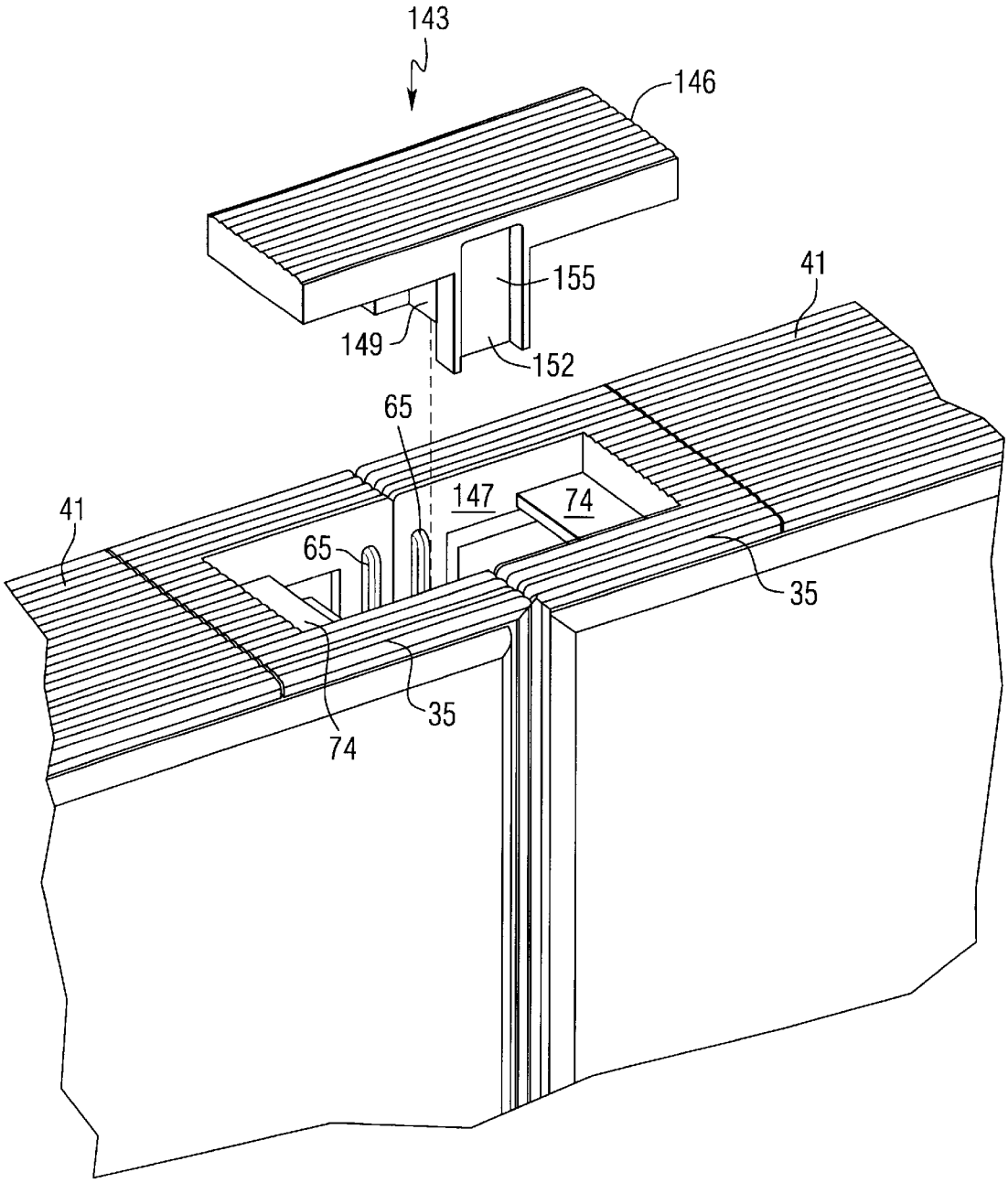
FIG. 7 is a detailed exploded view of one embodiment of a top connector assembly for the stackable panel system of the present invention.

In those instances where two stackable panels 26 have been attached in a side by side relationship (see FIG. 1), a top connector 143 is installed to join the two adjacent panels. As shown in FIG. 7, this T-shaped connector includes a horizontal top portion 146 which is generally twice the size of the length of the smaller leg portions 71 of the corner support 35. Thus, the horizontal portion 146 of the top connector 143 fills a gap 147 that exists between two adjacent stackable panels and rests within the recessed rectangular area 74 to be flush with the top of the panel. The lower vertical portion 149 of the T-shaped top connector 143 comprises a generally I-beam shape (when viewed from below) having a pair of vertically oriented legs 152 which, when installed, project frontwards and rearwards to form opposing channels 155 on the lower portion of the T-shaped connector. The distance between these legs 152 corresponds to the outer distance between two corresponding rails 65 which are disposed adjacent to each other for the two adjacent stackable panels 26. Thus, the opposing channels 155 on the lower portion of the T-shaped top connector 143 frictionally engage one rail 65 on each panel thereby securely locking the two adjacent panels together. It will be understood that the lower portion of the top connector may include rails to fit within complementary grooves in the corner connector. Together with the mast upright 83 which secures the stacked panel 26 to the wall 32, the mast assembly 77, intermediate connector 131, and the top connector 143 operate to provide an adequately rigid construction for the stackable panels such that they will not easily become dislodged without removing the top connector and individually removing each of the panels from each of the respective masts.

Figure 8:
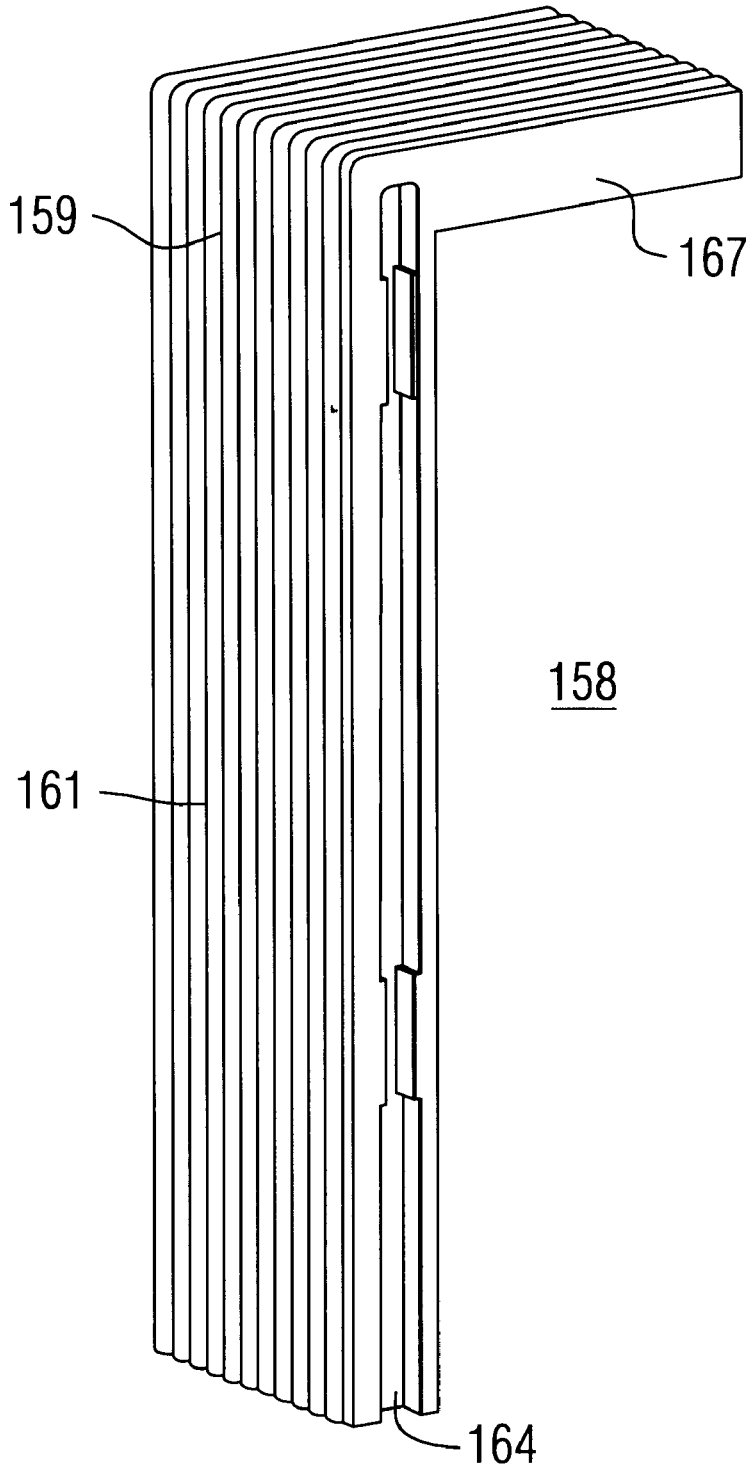
FIG. 8 is a detailed perspective view of a corner filler trim piece for the stackable panel system of the present invention.

When the desired number of stackable panels have thus been added to the wall system, the top corners of the uppermost stacked panel 125 are finished or trimmed off by the insertion of a corner filler trim piece 158 which matches the trim 41 appearance of the perimeter of the stackable panels 26. As shown in FIG. 8, on the exposed surface 159 this trim piece also is of an L-shaped construction, which generally matches the size of the central open area 59, the longer arm 161 of which includes the corresponding grooves 164 for the second portion of the sliding engagement mechanism which match the rails 65 forming the first portion in the corner supports 35. Alternatively, the trim piece 158 may have the rails. The shorter arm 167 of the L-shaped trim piece 158 rests within the recessed rectangular area 74 on the corner support 35, also being flush with the top of the panel.

By using the stackable panel 26 with the corner supports 35 of the present invention, in order to reconfigure an already installed modular wall office system, extensive disassembly of the existing setup does not have to be undertaken. Since only the mast base members need be specially configured for any type of top portion 109 of an existing wall system 32, the mast assembly 77 can be secured directly to the existing wall without having to disassemble that system and attach a special securement arrangement as is now common with conventional systems. Thus, newer panels can be attached to an existing system by installing the mast assemblies and then using the stackable panels of the present invention having the versatile corner support arrangement.

Figure 9:
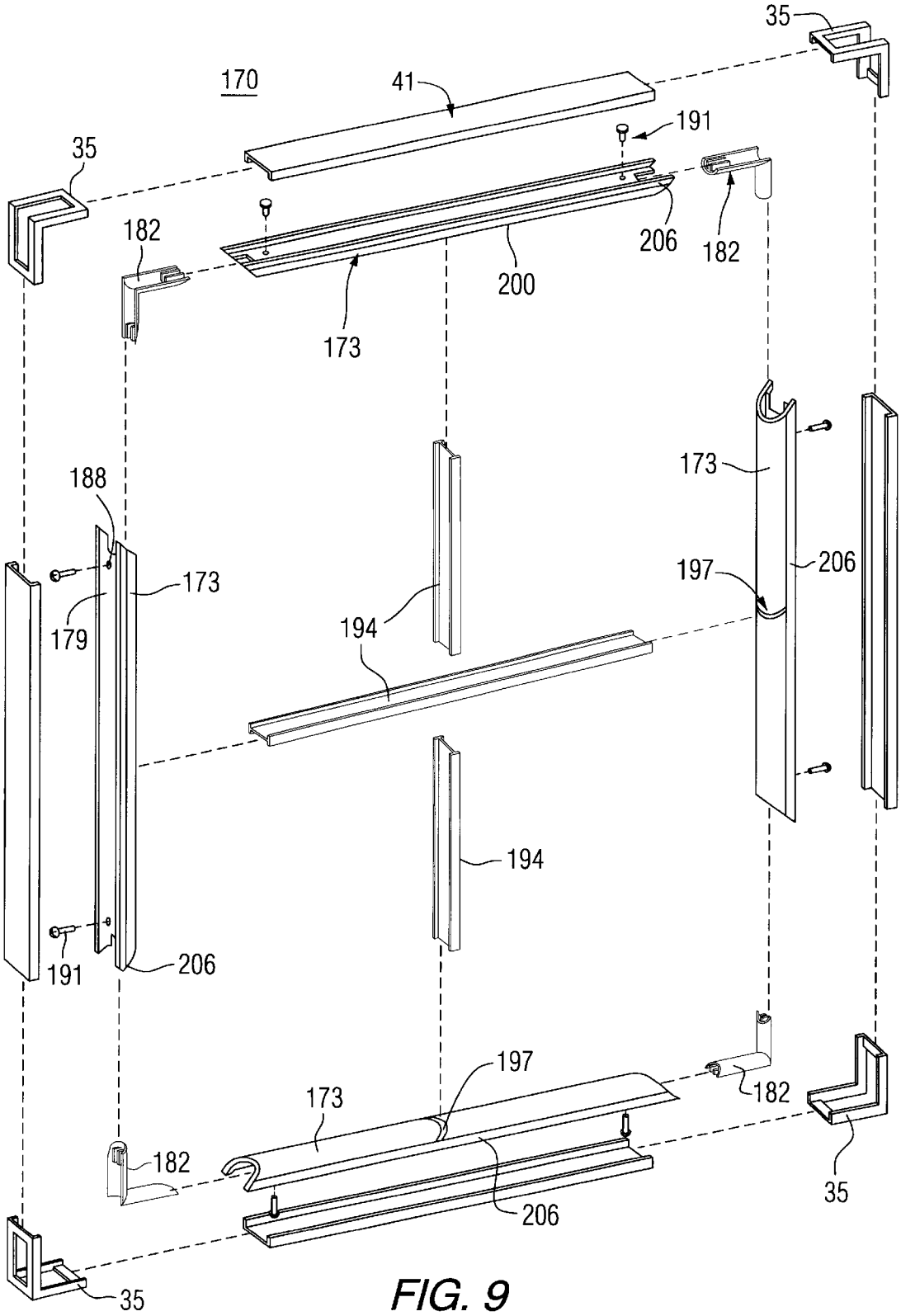
FIG. 9 is an exploded view of one embodiment of a perimeter framing system which may be used for the stackable panel system of the present invention.
Figure 10:
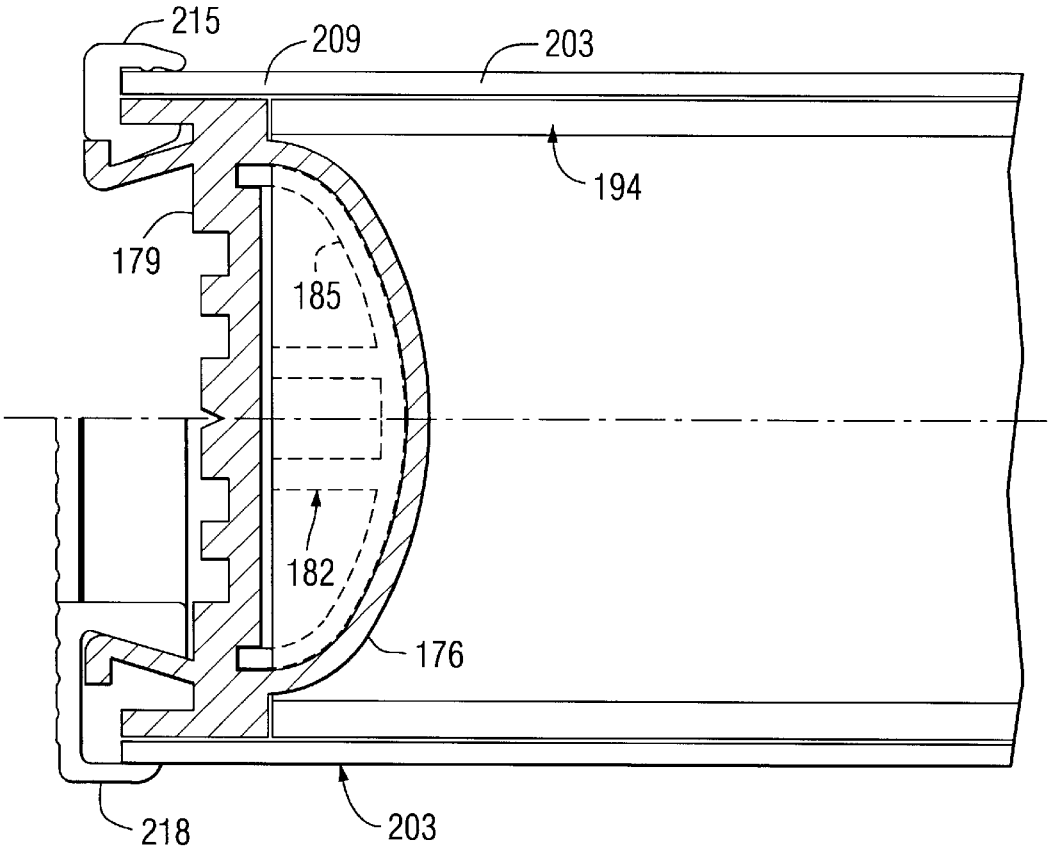
FIG. 10 is a cross sectional view of a perimeter framing member as shown in FIG. 9.

In order to construct a stackable panel of the present invention, the perimeter framing system 170 as shown in FIG. 9 can be utilized. Preferably the frame consists of an extruded aluminum member 173 having a cross section as shown in FIG. 10. This cross section generally includes a semi-circular or half moon configuration 176 on an interior section and a flat portion 179 on an opposite or exterior section, which can accept an extruded vinyl edge molding trim piece 41 which is common in office panel systems. When the length and height of the panel to be installed has been determined, the extruded aluminum perimeter frame members 173 can be cut to these desired lengths. Preferably, the aluminum members are mitered at about a 45° angle and four sections joined together to form a rectangular frame. In order to rigidly attach the extruded aluminum frame members 173, corner connector members 182 are utilized. Preferably, these corner connectors are made of a zinc die cast or molded plastic material. The corner connectors 182 have a corresponding half moon shape 185 complementary to that of the half moon section 176 of the perimeter frame member 173. A first leg of the corner connector 182 thus is inserted into one aluminum frame member and the other leg is inserted into the other frame member. One or more screw holes 188 are included in the flat portion 179 of the frame member 173 and a screw 191 is used to connect a frame member to each leg of the corner connector 182. In this manner all four sides of the rectangular panel frame are rigidly secured at their corners according to the desired dimensions, the four corner connectors 182 providing rigidity and stability for the perimeter framing system 170.

The flat portion 179 of the extruded perimeter frame members 173 also is adapted to accept the corner supports 35 as previously disclosed herein. Again, the corner supports are attached to each of the corners of the assembled aluminum perimeter frame by self tapping screws 47 which are inserted through the holes 50 and slots 53 in the corner supports and screwed into the aluminum perimeter frame. If necessary, extruded aluminum I-beam mullions 194 can be used to span the distance either lengthwise or widthwise between parallel frame members. Preferably, a slot 197 may be machined into a half moon section 176 of the corresponding frame members in order to insert the mullions 194 therein. These mullions would be inserted, for example, prior to the final securement of the perimeter members and are thereby captured between the parallel frame members when the corner connectors 182 are secured therein. Thus, no additional means of securing the mullions to the perimeter frames are necessary.

A unique advantage of this semi-circular half moon cross section 176 on the inner portion 200 of the perimeter frame allows various types of covering materials 203 to be used as the outside surface of the stackable panel 26. For example, if a translucent material or even a clear glass panel is to be installed as the panel cover for the stackable panel, the outer covering can be easily secured to the perimeter frame without exposing the connecting hardware of the panel frame. The perimeter frame includes a relatively flat portion 206 adjacent the flat portion 179 so as to provide a square area for the attachment of the panel skin or covering. In addition, the I-beam mullions also provide an intermediate area of support and also can be used as separations between panes of clear glass to give the effect of a multipane configuration.

Figure 11:
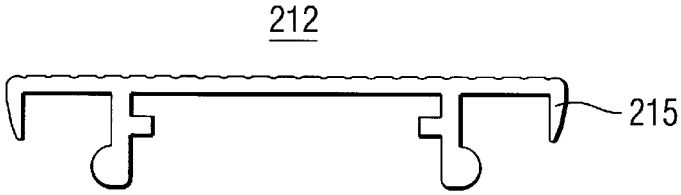
FIG. 11 is a cross sectional view of one embodiment of a perimeter framing trim piece for the stackable panel system of the present invention.
Figure 12:
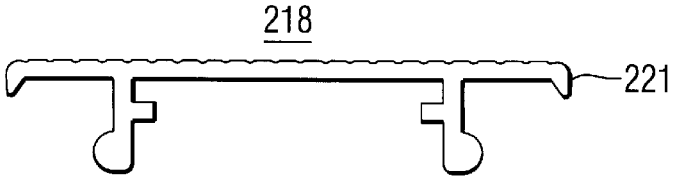
FIG. 12 is a cross sectional view of a second embodiment of a perimeter framing trim piece for the stackable panel system of the present invention.

A suitable adhesive, preferably a double sided tape, is applied to the flat portion 206 of the extruded perimeter frame members 173. The desired panel skin 203 is then secured to the perimeter frame by means of this adhesive. In order to cover the edge portions 209 of the panel skin, the trim piece 212 (FIG. 11) includes an elongated outer leg portion 215 which over hangs the edges of the panel skin 203. Thus, any rough surfaces which may exist, such as for example which may be created in an aluminum mesh product, are covered by the trim 212. Although it may be possible to use the trim piece 212 as the securement means for the panel skin to the frame, since a variety of panel skins are to be accommodated, which panel skins have various thicknesses, it is preferable to use the adhesive and merely use the trim 212 to cover over any rough edges which may exist. For stackable panels constructed with an upholstered panel skin, not having rough edges for example, a trim piece 218 having relatively shorter leg portions 221 as shown in FIG. 12 may be used as is described more fully hereinafter. In addition the corner supports 35 include trim leg portions 224 according to the trim design which is used for the differing type panel skins for a uniform appearance.

Because of the use of the semi-circular half moon section for the perimeter frame and the use of the corner connectors to connect each member of the frame, the screws which are used to secure the pieces together do not project into the otherwise open square area 227 defined by the perimeter frame, but are hidden within the respective semi-circular half moon section 176, 185. That is, in those cases where a translucent or clear panel skin is used, the screws 191 which are used to attach these members are not visible which is not the case with conventional panel frame construction. Thus a "clean" appearance is provided in the interior portions of the perimeter frame. Therefore, the perimeter frame of the stackable panel of the present invention allows the use of any type of non-upholstered panel skin on the covering, thereby giving great versatility to the present invention.

Various different modifications of these stackable panels of the present invention may be utilized. For example, although it is desired to have standardized panel frames which have the corner supports of the present invention on each corner, it may be also desirable to provide what may be referred to as "top" stackable panels. In this instance, only the bottom two corners of the panel frame may include the corner support arrangement 23 and the upper corners on the opposite ends can have conventional extruded trim members thereon. However, due to the added advantage that the T-shaped top connectors provide in "locking" two adjacent panels together, and due to the standardization which can be easily accomplished by having all four corners include the corner supports, it is preferable to construct each stackable panel having these corner supports at all four corners. In addition, the top connector can also have various configurations such as an X- or an L-shaped connection, when matching the stackable panels of the present invention to the existing wall configurations. For example, at a corner of a wall, the L-shaped connector for the top corners of adjacent panels can be used so as to lock the perpendicularly situated stackable panels. This is also true for a corner connection where the X-shaped top connector can be used to trim off and lock intersecting stacked panels.

Figure 13:
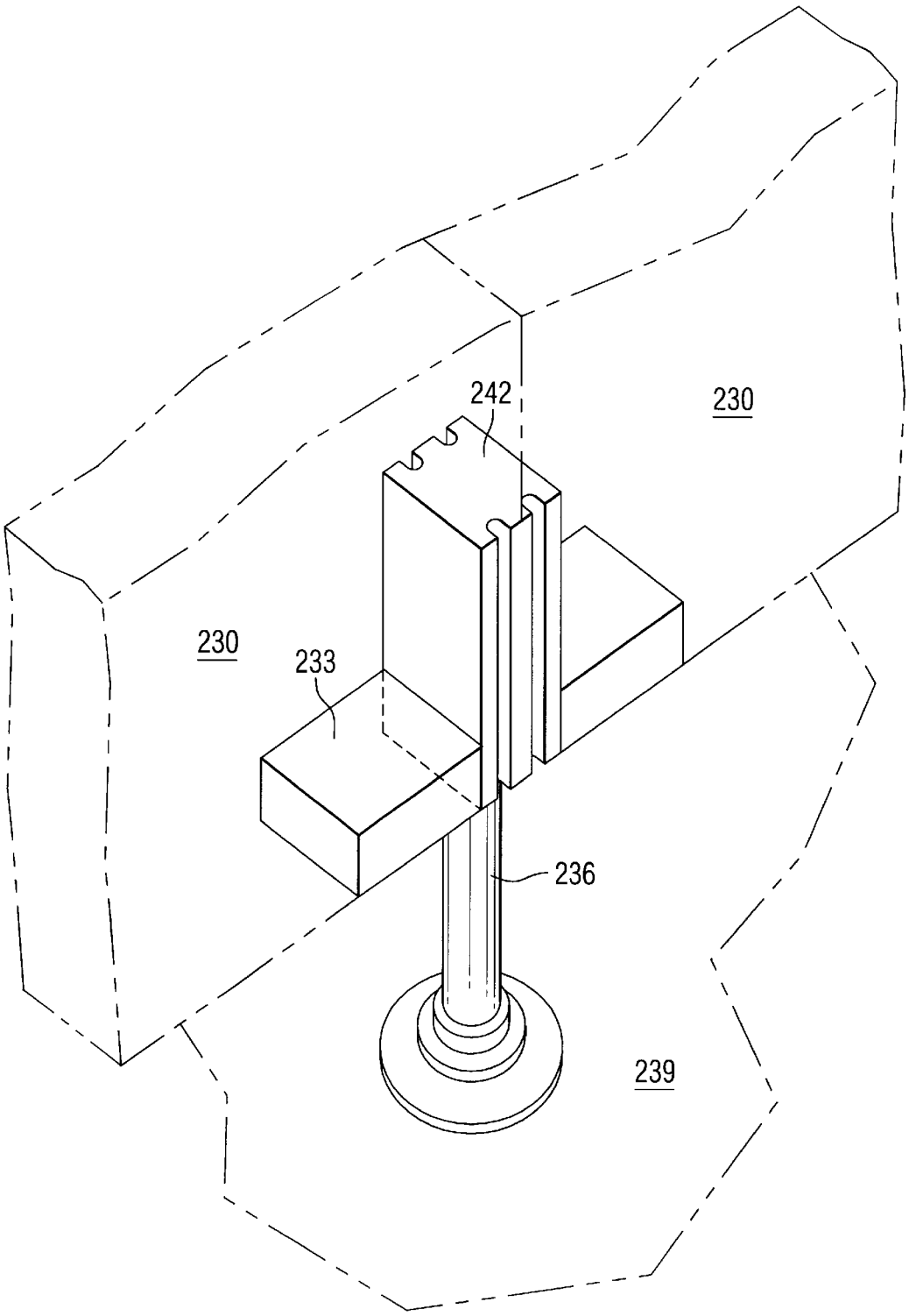
FIG. 13 is a perspective view of one embodiment of a leveling glide for a flee standing stackable panel system of the present invention.

In addition to using the stackable panels 26 of the present invention on top of an existing wall system, it is also possible to use these panels as a floor mounted or freestanding room or space divider 230. In this configuration, rather than having a mast base member which is used to secure the mast upright to a top section of a wall, the floor mounted mast base portion 233 can include a leveling glide 236 which is typically used when supporting a stackable panel 26 on the floor 239, as shown in FIG. 13. Thus, on either end of a stackable panel of the present invention, a floor mounted upright mast portion 242 is secured to a floor mounted mast base portion 233 which includes this leveling glide 236. This gives an additional advantage to having an mast upright 83 separate from the mast base such that any type of base can be used, even one which can support the stackable panel on the floor. For the stackable panels which are to be joined adjacent to each other and resting on the floor, a one piece, double-sided mast upright (not shown) can be used which then incorporates the leveling glide 236 for supporting the panel on the floor 239. The use of such leveling glides are well known in the art. Thus, the stackable panel construction having the four corner support members of the present invention provides many options to the work space designer.

Although the stackable panels 26 of the present invention are shown attached to a wall system or floor mounted arrangement in an adjacent or side-by-side relationship (FIG. 1), it will be understood by those skilled in the art that numerous connections may be used, such as a corner, L-shaped connection, or an intersecting X-shaped connection for example. By way of further example, in the floor mounted embodiment, instead of supplying a double-sided or "back-to-back" mast upright, an L-shaped mast upright could be provided for a corner of a room divider. Such a mast assembly could also be used on the top portion of a corner connected or intersecting wall system.

Figure 14:
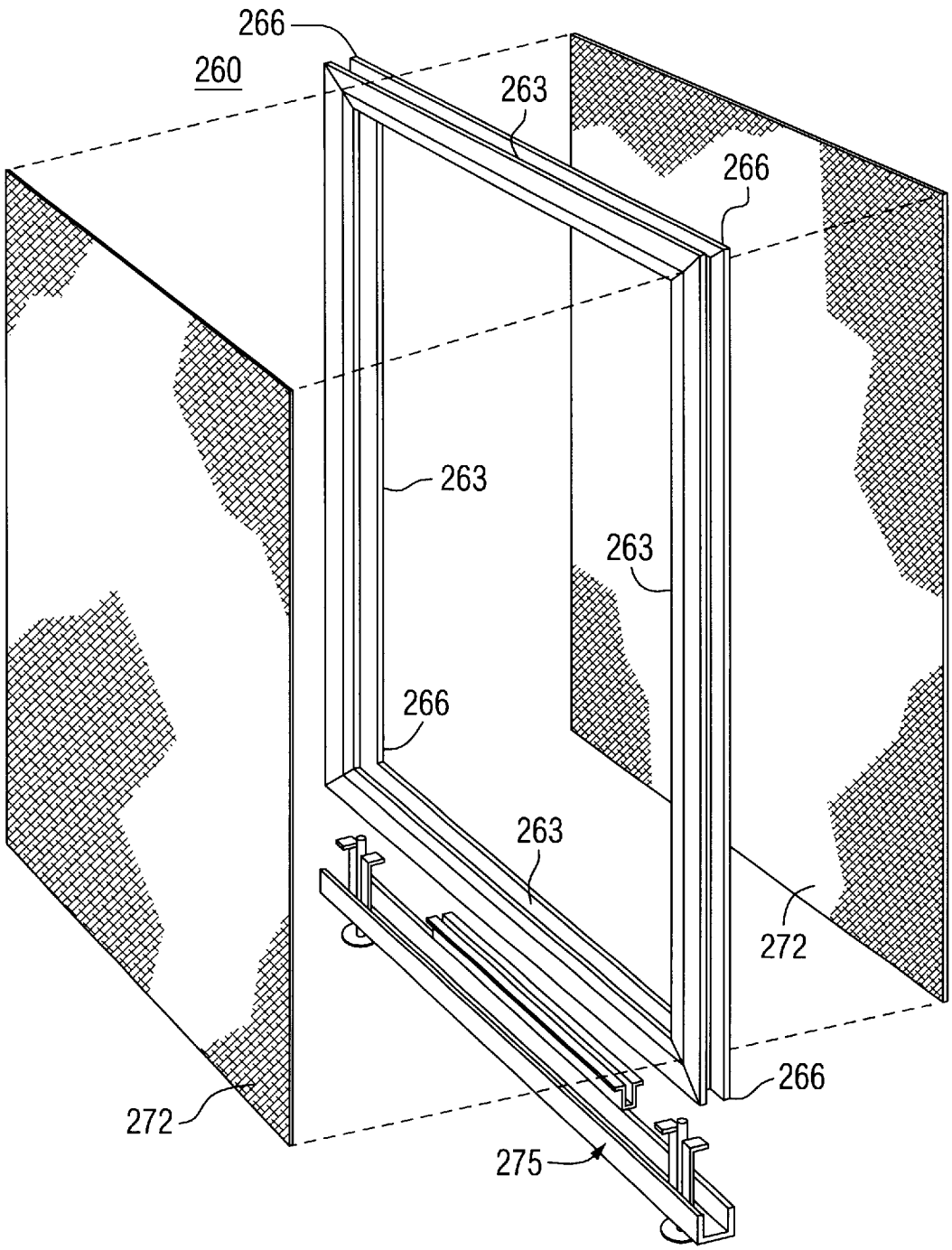
FIG. 14 is an exploded view of a prior art panel system.

In addition to utilizing the corner mounting arrangement 23 of the present invention on new stackable panels, such as those formed by the extruded aluminum frame member 173 and corner connector 182 discussed above, the various components having the sliding engagement mechanism used to mount a stackable panel can also be incorporated into existing panel systems. One example of such a panel system is disclosed in U.S. Pat. Nos. 4,567,698 and 5,024,030 issued to Morrison. Both of the patents are assigned to the present assignee and are hereby incorporated by reference herein. As shown in FIG. 14, a typical prior art panel 260 comprises a rectangular frame constructed of four (4) channel pieces 263 which are held together at their corners 266 by clips 269 (see FIG. 15). Applied to the opposed surfaces of the frame are a panel skin 272, which may be one of numerous materials, such as metal, glass or typically a fabric covered panel. Also included may be a base 275 which supports the panel 260 on the floor. By way of further example, this panel 269 may also be used as the existing wall system 32 to which the stackable panels 26 of the present invention may be added.

Figure 15:
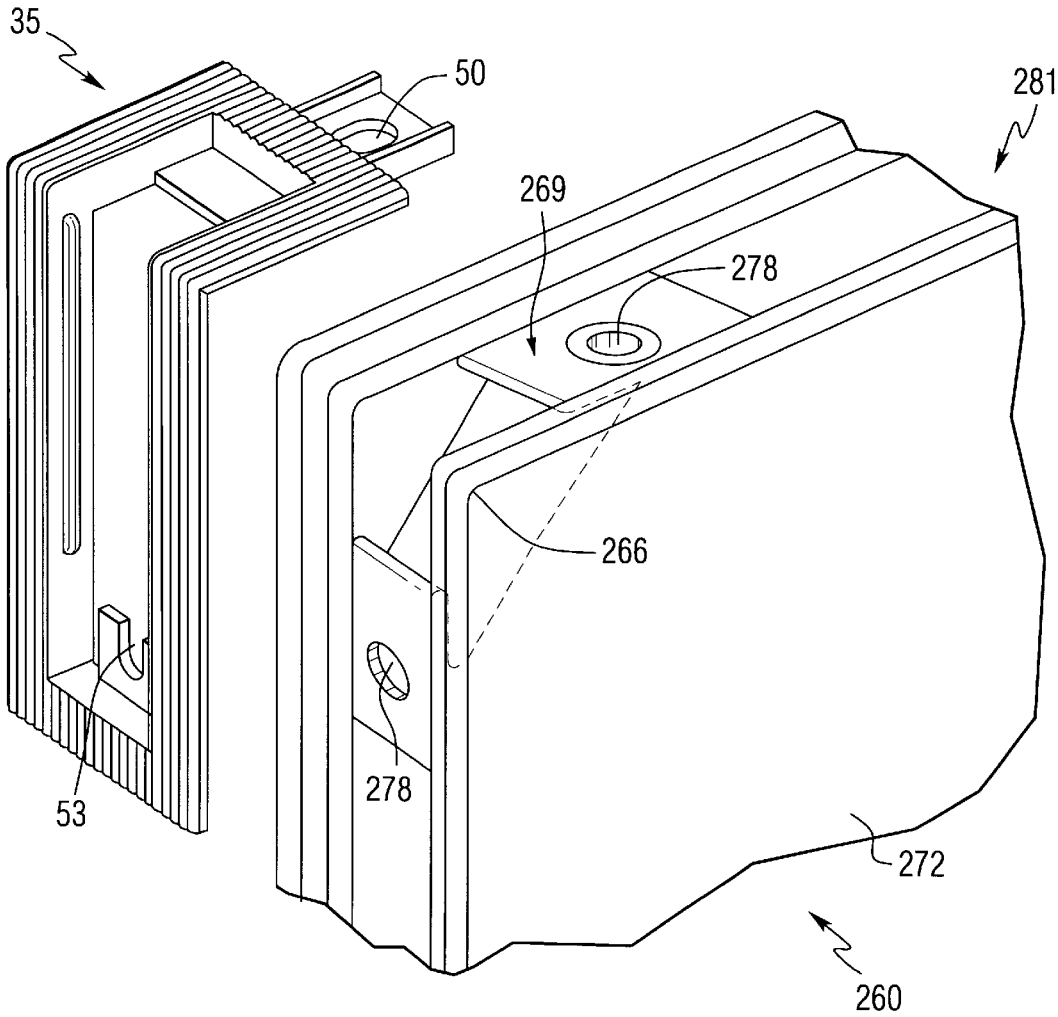
FIG. 15 is a perspective view of an alternate embodiment of the corner mounting arrangement of the present invention as used with existing panel designs to create a stackable panel system.

Referring now in detail to FIG. 15, incorporation of the corner mounting arrangement 23 into this existing panel 260 is discussed. As shown therein, an L-shaped corner support 35 can be attached to each corner 266 by screws (not shown) which pass through the opening 50 and slot 53 to threadingly engage holes 278 in the panel clips 269. By installing these corner supports 35 having the first portion of a sliding engagement mechanism, the existing panel 260 can then be used as either a stackable panel 26 of the present invention, or as a free standing divider 230 as discussed above. Additionally, if the present construction of the existing panel 260 permits, the upper corners can have installed the corner support 35 so that stackable panels can be added thereon. Alternatively, since in this example the top portion 281 of the panel 260 is relatively flat, the flat bottom mast base 119 (FIG. 4) can be bolted thereon as part of the mast assembly 77 for adding on stackable panels 26. In the example shown, upholstered or fabric covered panel skins 272 are used. Thus the upholstered trim piece 218 (FIG. 12) would be used to provide the uniform perimeter appearance.

For converting an existing panel 260 into a stackable panel, all a person need do is obtain a corner support arrangement "kit" which can include a plurality of L-shaped corner supports 35, mast assemblies 77, which may also include the differing mast bases 80 and 119, intermediate connectors 131, top connectors 143, corner fillers 158, floor mounted bases 233 and/or trim pieces 212, 218 which have incorporated therein the respective complementary rails and grooves for the sliding engagement mechanism. Since the components are preferably made of an extruded plastic or vinyl material, they can be painted to be compatible with the panel trim appearance to which they are installed, either by having a substantially identical color or some other color which complements the panel system's appearance. By incorporating these components with existing panels 260, they can be converted into stackable panels since they would then include the sliding engagement mechanism for connection to other panels, mounted atop a wall system or used as space dividers, all as described hereinbefore.

While specific modes of practicing the invention have been described in detail, it will be appreciated by those skilled in the art that various modifications and alternatives to those details may be developed in light of the overall teachings of the disclosure. Accordingly, the particular arrangements disclosed are meant to be illustrative only and not limiting to the scope of the invention which is to be given the full breadth of the appended claims, and any and all embodiments thereof.

What is claimed is:

1. A modular office panel comprising:

a perimeter frame, wherein each corner of the perimeter frame includes a corner support;

each of said corner supports comprising a generally L-shaped member, one leg of the L-shaped corner support having a first portion of a sliding engagement mechanism including a pair of opposed rails thereon; and means for supporting the perimeter frame in an upright position, said supporting means having a second portion of the sliding engagement mechanism having a pair of opposed grooves adapted to receive the opposed rails of the L-shaped corner supports.

2. The modular office panel of claim 1, further comprising a plurality of panel trim pieces disposed about an outer perimeter of the office panel and having a predetermined trim outer surface, and said panel trim pieces are disposed between the corner supports wherein an outer surface of each of said corner supports is generally compatible with the predetermined trim outer surface.

3. The modular office panel of claim 1, wherein said means for supporting the perimeter frame in an upright position comprises a pair of mast assemblies, and each of said mast assemblies comprises a mast base and a mast upright secured thereto, wherein the mast upright comprises the second portion of the sliding engagement mechanism.

4. The modular office panel of claim 3, wherein the mast base is adapted to be attached to a top portion of a wall assembly such that the modular office panel is attached to the top portion of the wall assembly.

5. The modular office panel of claim 3, wherein the mast base is adapted to rest upon a floor surface, such that the modular office panel comprises a freestanding space divider.

6. The modular office panel of claim 1, wherein the other leg of the L-shaped member includes a recessed area.

7. The modular office panel of claim 1, wherein the generally L-shaped member includes a central open area such that said opposed rails project inward into the central open area from the one leg.

8. The modular office panel of claim 7, wherein the other leg of the L-shaped member includes a recessed area.

9. The modular office panel of claim 8, further comprising a generally L-shaped corner trim piece adapted to be secured in the central open area, wherein a first portion of the L-shaped corner trim piece includes a second pair of opposed grooves adapted to receive the opposed rails of the L-shaped corner support therein and a second portion of the L-shaped corner trim piece is adapted to fit within the received area.

10. The modular office panel of claim 9, wherein the modular office panel further comprises means for securing the corner supports to the perimeter frame, such that said securing means are covered by said corner trim pieces.

11. A stackable panel for a modular office wall system, the stackable panel comprising:

a perimeter frame;

a corner support member disposed on each of the corners of the perimeter frame, each of said corner support members having a first leg portion including a pair of opposed rails disposed thereon;

a mast assembly comprising a mast base secured to a top portion of the modular office wall system and a mast upright attached to the mast base, wherein the mast upright includes a pair of opposed grooves adapted to receive the opposed rails of the corner support member;

a corner trim piece generally corresponding to the corner support member, one leg of the corner trim piece having a second pair of opposed grooves for receiving the opposed rails of the corner support member; and a plurality of perimeter trim means disposed about the perimeter frame between said corner support members, wherein an outer surface of each of the corner support members, the mast upright, the corner trim pieces and said perimeter trim means are generally compatible.

12. The stackable panel of claim 11, further comprising a plurality of panel trim pieces disposed about an outer perimeter of the stackable panel and having a predetermined trim outer surface, and said panel trim pieces are disposed between the corner supports wherein an outer surface of each of said corner supports is generally compatible with the predetermined trim outer surface.

13. The stackable panel of claim 11, wherein the mast base is adapted to be attached to a top portion of a wall assembly such that the modular office panel is attached to the top portion of the wall assembly.

14. The stackable panel of claim 11, wherein the other leg of the L-shaped member includes a recessed area.

15. The stackable panel of claim 11, wherein the generally L-shaped member includes a central open area such that said opposed rails project inward into the central from the one leg.

16. The stackable panel of claim 15, wherein the other leg of the L-shaped member includes a recessed area.

17. The stackable panel of claim 16, further comprising a generally L-shaped corner trim piece adapted to be secured in the central open area, wherein a first portion of the L-shaped corner trim piece includes a second pair of opposed grooves adapted to receive the opposed rails of the L-shaped corner support therein and a second portion of the L-shaped corner trim piece is adapted to fit within the received area.

18. The stackable panel of claim 17, wherein the stackable panel further comprises means for securing the corner supports to the perimeter frame, such that said securing means are covered by said corner trim pieces.

19. A perimeter frame for an office panel, the perimeter frame comprising:

a plurality of frame members, each of said frame members comprising, in cross section, a generally circular interior frame section and an opposed, generally flat exterior frame section;

a plurality of corner connectors for joining said plurality of frame members, each of said corner connectors being of a generally L-shaped configuration having a circular member receivable within the generally circular interior frame section and a generally flat portion in abutting relationship with the generally flat exterior frame section; and means for securing said plurality of corner connectors to said plurality of frame members such that said securing means are not visible within an interior area defined by the perimeter frame.

20. A corner mounting arrangement kit for attachment to modular office panels, said corner mounting arrangement kit comprising:

a plurality of generally L-shaped corner supports each having a generally open central area, one leg of each of the L-shaped corner supports having a first portion of a sliding engagement mechanism thereon;

a plurality of mast assemblies each having a second portion of the sliding engagement mechanism with a complementary surface adapted to receive the first portion, the mast assemblies adapted to support a modular office panel;

a plurality of corner trim pieces each having the second portion of the sliding engagement mechanism thereon;

at least one top connector, each of the top connectors having means for joining two adjacent modular office panels; and wherein an outer surface of each of the L-shaped corner supports, the mast assemblies, the corner trim pieces and the top connector are generally compatible.

21. The corner mounting arrangement kit of claim 20, wherein the first portion of the sliding engagement mechanism comprises a pair of opposed rails and the second portion of the sliding engagement mechanism comprises a pair of opposed grooves adapted to receive the opposed rails of the L-shaped corner support therein.

22. The corner mounting arrangement kit of claim 20, wherein each of said mast assemblies comprises a mast base and a mast upright secured thereto, wherein the mast upright comprises the second portion of the sliding engagement mechanism.

23. The corner mounting arrangement kit of claim 22, wherein the mast base is adapted to be attached to a top portion of a wall assembly such that the modular office panel is attached to the top portion of the wall assembly.

24. The corner mounting arrangement kit of claim 22, wherein the mast base is adopted to rest upon a floor surface, such that modular office panel comprises a freestanding spare divider.

25. The corner mounting arrangement kit of claim 23, wherein the other leg of the L-shaped member includes a recessed area.

26. The corner mounting arrangement kit of claim 21, wherein the generally L-shaped member includes a central open area such that said opposed rails project inward into the central from the one leg.

27. The corner mounting arrangement kit of claim 25, wherein the other leg of the L-shaped member includes a recessed area.

28. The corner mounting arrangement kit of claim 26, further comprising a generally L-shaped corner trim piece adapted to be secured in the central open area, wherein a first portion of the L-shaped corner trim piece includes a second pair of opposed grooves adapted to receive the opposed rails of the L-shaped corner support therein and a second portion of the L-shaped corner trim piece is adapted to fit within the received area.

29. A modular office panel comprising:

a perimeter frame, wherein each corner of the perimeter frame includes a corner support;

each of said corner supports comprising a generally L-shaped member, one leg of the L-shaped corner support having a first portion of a sliding engagement mechanism including a pair of opposed grooves therein; and means for supporting the perimeter frame in an upright position, said supporting means having a second portion of the sliding engagement mechanism having a pair of opposed rails such that the opposed grooves of the L-shaped corner supports are adapted to receive the opposed rails.

30. The modular office panel of claim 29, further comprising a plurality of panel trim pieces disposed about an outer perimeter of the office panel and having a predetermined trim outer surface, and said panel trim pieces are disposed between the corner supports wherein an outer surface of each of said corner supports is generally compatible with the predetermined trim outer surface.

31. The modular office panel of claim 29, wherein said means for supporting the perimeter frame in an upright position comprises a pair of mast assemblies, and each of said mast assemblies comprises a mast base and a mast upright secured thereto, wherein the mast upright comprises the second portion of the sliding engagement mechanism.

32. The modular office panel of claim 31, wherein the mast base is adapted to be attached to a top portion of a wall assembly such that the modular office panel is attached to the top portion of the wall assembly.

33. The modular office panel of claim 31, wherein the mast base is adapted to rest upon a floor surface, such that the modular office panel comprises a freestanding space divider.

34. The modular office panel of claim 29, wherein the other leg of the L-shaped member includes a recessed area.

35. The modular office panel of claim 29, wherein the generally L-shaped member includes a central open area.

36. The modular office panel of claim 35, wherein the other leg of the L-shaped member includes a recessed area.

37. The modular office panel of claim 36, further comprising a generally L-shaped corner trim piece adapted to be secured in the central open area, wherein a first portion of the L-shaped corner trim piece includes a second pair of opposed rails adapted to receive the opposed grooves of the L-shaped corner support therein and a second portion of the L-shaped corner trim piece is adapted to fit within the recessed area.

38. The modular office panel of claim 37, wherein the modular office panel further comprising means for securing the corner supports to the perimeter frame, such that said securing means are covered by said corner trim pieces.

* * * * *